United States Patent [19]

Jacobi

[11] Patent Number: 4,767,035

[45] Date of Patent: Aug. 30, 1988

[54] CONTAINER WITH DISCHARGE TUBE

[75] Inventor: Stephen V. Jacobi, Ballwin, Mo.

[73] Assignee: Monsanto Company, St. Louis, Mo.

[21] Appl. No.: 919,406

[22] Filed: Oct. 16, 1986

[51] Int. Cl.[4] ..... B67D 3/00

[52] U.S. Cl. ..... 222/527; 222/538; 222/541; 222/566; 222/573

[58] Field of Search ..... 222/526–530, 222/572, 573, 566, 541, 538, 105, 183, 185, 535; 229/109, 119, 122, 7 R; 220/85 SP

[56] References Cited

U.S. PATENT DOCUMENTS

| | | | |
|---|---|---|---|
| 2,154,584 | 4/1939 | Rossi | 222/527 |
| 2,543,909 | 3/1951 | Hatheway, Jr. | 222/566 |
| 2,620,119 | 12/1952 | George | 229/109 X |
| 2,775,373 | 12/1956 | Coralline | 222/528 X |
| 2,894,661 | 7/1959 | Simkins | 222/528 X |
| 2,894,666 | 7/1959 | Campbell, Jr. | 222/528 X |
| 2,957,614 | 10/1960 | Krajcovic | 222/530 X |
| 3,078,018 | 2/1963 | Galloway | 222/183 |
| 3,146,931 | 9/1964 | Neff et al. | 222/541 X |
| 3,330,448 | 7/1967 | Murphy | 222/529 X |
| 3,433,400 | 3/1969 | Hawkins | 222/185 X |
| 3,633,794 | 1/1972 | Croley | 222/528 X |
| 3,957,179 | 5/1976 | Bamburg et al. | 222/529 X |
| 3,972,454 | 8/1976 | Croley | 229/7 R X |

*Primary Examiner*—Joseph J. Rolla
*Assistant Examiner*—David H. Bollinger
*Attorney, Agent, or Firm*—Senniger, Powers, Leavitt and Roedel

[57] ABSTRACT

A container for fluent material in bulk quantity, having a top, a bottom, and at least one sidewall. This sidewall has a removable portion to form an opening in the wall adjacent the bottom of the container. A flange extends around the opening on the inside of the container, and a discharge tube of flexible sheet material is attached at one end to the flange. The tube is initially in a folded condition on the inside of the container and is accessible upon removal of the sidewall portion so that it may be pulled outwardly through said opening and unfolded for discharge of the fluent material from the container through the discharge tube.

17 Claims, 2 Drawing Sheets

CONTAINER WITH DISCHARGE TUBE

BACKGROUND OF THE INVENTION

This invention relates generally to containers, and in particular to a container for fluent materials in bulk quantities having a discharge tube.

Bulk fluent materials such as fertilizers or granular herbicides are frequently packaged in bags in relatively small quantities, such as 50-pound quantities. When a large amount of material is needed, opening and emptying numerous bags can be time-consuming. The bags can also tear during shipment and handling or while they are being opened and emptied, causing spills. Spills also occur because it is difficult to control pouring the material from the bag. These spills are wasteful, and depending upon the material can also be hazardous. Pouring the material from bags also creates dust which can result in the inhalation or ingestion of the material.

SUMMARY OF THE INVENTION

Among the several objects of the invention are: the provision of a container for fluent materials in bulk quantities; the provision of such a container that can be quickly and easily opened; the provision of such a container that is resistant to tearing during shipping, handling, opening, and emptying; and the provision of such a container having a discharge tube which improves control over emptying and minimizes the creation of dust.

A container of the present invention has a top, a bottom, and at least one sidewall. Means is provided defining a portion of the sidewall which, when removed, forms an opening in the sidewall adjacent the bottom of the container. A flange extends around the opening on the inside of the container. A flexible discharge tube, fastened at one end to the flange, is provided in a folded condition on the inside of the container. The tube is accessible when the sidewall portion is removed so that it can be pulled outwardly through the opening and unfolded for discharging the fluent material from the container through the discharge tube.

The flange is preferably rectangular with a top, two sides, and a bottom, the bottom being bent to lie generally flat against the bottom of the container with the top and side portions lying generally flat against the sidewall of the container. The opening can thus extend to the bottom of the container to facilitate complete emptying of the container. Indicia on the outside of the container, or a line of weakness such as perforations, may define the removable portion of the sidewall. The flange surrounds the opening helping to prevent tearing. A liner can be provided on the inside of the container, providing extra protection against spills. The discharge tube helps to control and direct the flow of material from the container while minimizing the creation of dust.

The container of this invention thus provides a sturdy container for fluent materials in bulk quantities. The container is quickly and easily opened and emptied, and because of its greater capacity eliminates the opening and emptying of multiple packages. Moreover, the container is resistant to damage during shipping, handling, opening and emptying.

These and other advantages of the invention will be more apparent with reference to the preferred embodiment of the invention described below.

BRIEF DESCRIPTION OF THE DRAWINGS

Corresponding reference characters indicate corresponding parts throughout the drawings.

DETAILED DESCRIPTION OF THE PREFERRED EMBODIMENT

Figure 1:
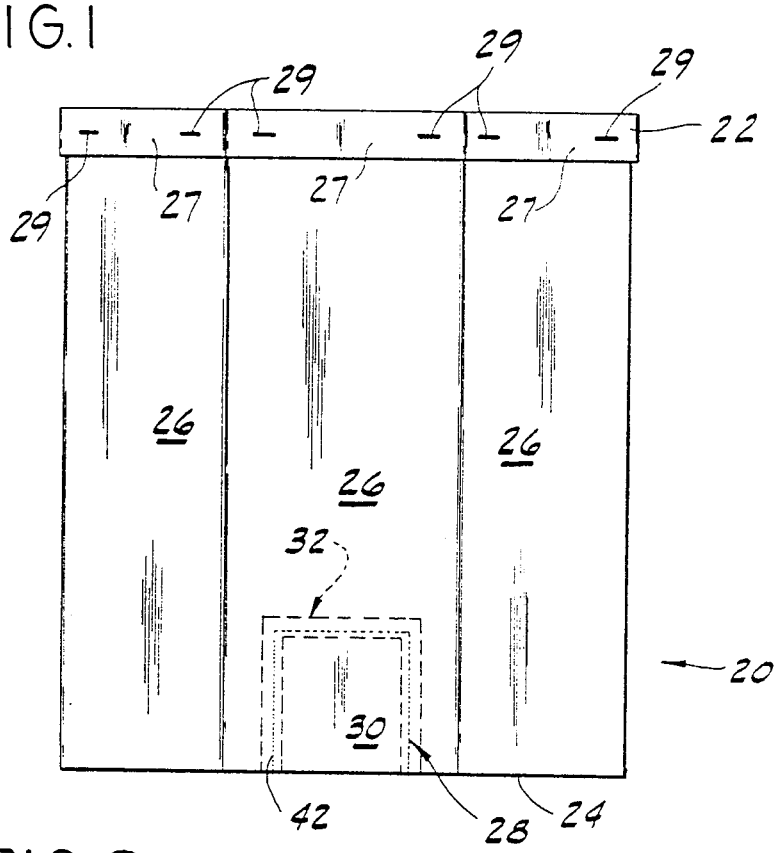
FIG. 1 is a side elevational view of a container constructed according to this invention, showing a removable portion of one sidewall.
Figure 2:
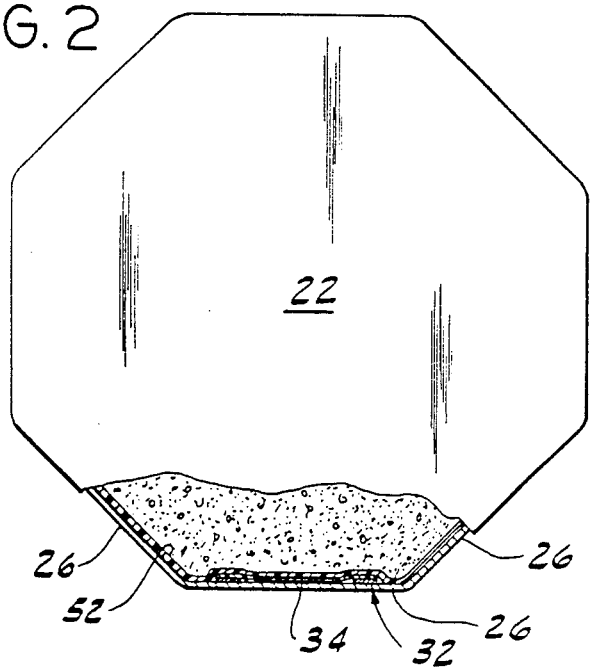
FIG. 2 is a top plan view of the container with a portion broken away.

A container constructed according to the present invention is indicated generally at 20 in FIG. 1. The container has a top in the form of a removable lid 22, a bottom 24, and sidewalls each designated 26. In the preferred embodiment container 20 has eight sides with a regular octagonal cross-section. The lid 22 is of corresponding shape and has depending sides 27 which extend down over the sidewalls 26 and are secured thereto as with staples 29. The container 20 is preferably made from heavy-gage cardboard, and thus is substantially rigid.

Indicated generally at 28 is means defining a portion 30 of one sidewall of the container that can be removed to form an opening in the sidewall adjacent the bottom 24 of the container. A flange 32 extends around the opening on the inside of the container 20. A discharge tube 34, preferably made of a flexible sheet material, is attached at one end to the inner side of flange 32. The tube 34 is initially folded compactly on the inside of the container adjacent sidewall portion 30 and is accessible upon the removal of the sidewall portion 30 so that it may be pulled outwardly through the opening and unfolded for discharge of the material from the container through the discharge tube 34. The discharge tube 34 is preferably made from a flexible sheet material such as a 4-mil polyethylene or polypropylene film. The tube can be secured at one end to the flange with adhesive.

Figure 3:
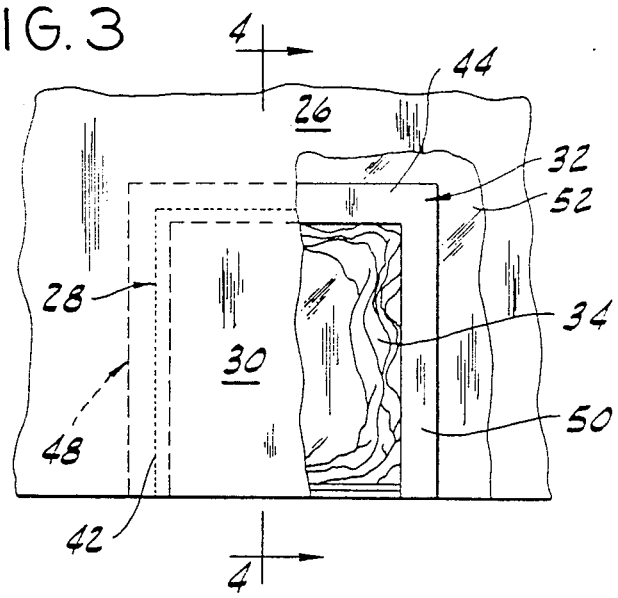
FIG. 3 is an enlarged portion of FIG. 1, a part of the removable sidewall portion being broken away to show a flange and discharge tube.

Means 28 can comprise suitable indicia (not shown) to indicate where to cut the container to provide a removable portion 30. Means 28 defining the removable portion 30 of the sidewalls preferably comprises a line of weakness, and in the case of a container made of corrugated cardboard, or the like, perforations can be conveniently used to define the line of weakness. As best shown in FIG. 3, the flange 32 functions as a backup member directly behind means 28 so that if a knife or other sharp tool is used to remove portion 30, the discharge tube 34 will not be damaged.

The flange 32 is generally rectangular, comprising a top portion 44, a bottom portion 46, and side portions 48 and 50. The bottom portion 46 is bent to lie generally flat against the bottom 24 of the container, and the top portion 44 and side portions 48 and 50 lie generally flat against the sidewall. This allows the opening to extend to the bottom of the container, facilitating complete emptying of the container. Of course, the flange could be made some other shape, for example, circular, hexagonal, or octagonal. Furthermore, the bottom of the flange does not necessarily have to be bent to lie flat with the bottom of the container. The flange 32 is preferably made of cardboard but it could be made of some other material, for example metal or plastic sheet that is resistant to cutting. The flange 32 is suitably secured to the inside of the container, as by adhesive or double-sided tape.

A liner 52, preferably in the form of a bag, may be provided inside the container with the flange 32 between the liner and the respective sidewall of the container. Liners are particularly desirable for corrosive or hygroscopic materials. Liner 52 can be made from 4 mil polyethylene sheet, or some other material suitable for the material being contained. The liner 52 is adapted to be cut to enable the flow of material into the discharge tube.

OPERATION

Figure 4:
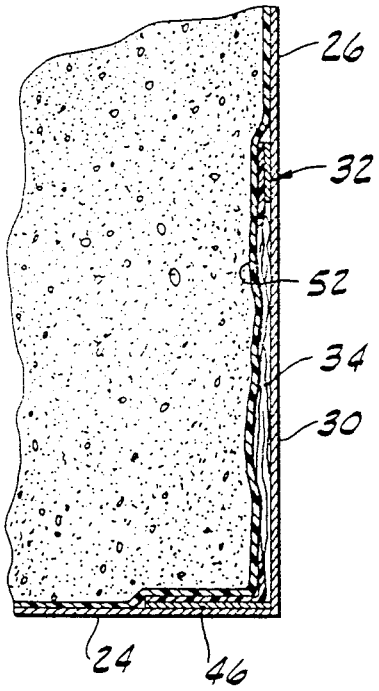
FIG. 4 is a cross-sectional view taken on line 4—4 of FIG. 3 showing the removable sidewall portion intact and the discharge tube folded.

The container 20 is shown in the unopened condition in FIG. 4. A utility knife or some other tool may be used to facilitate opening the sidewall of the container along the sides and top of portion 30. There is preferably a line of perforations to facilitate this opening, or at least some indicia on the sidewall indicating where to cut. The flange 32 overlaps the line of weakness and protects the discharge tube 34 and optional liner 52 from being damaged during opening.

Figure 5:
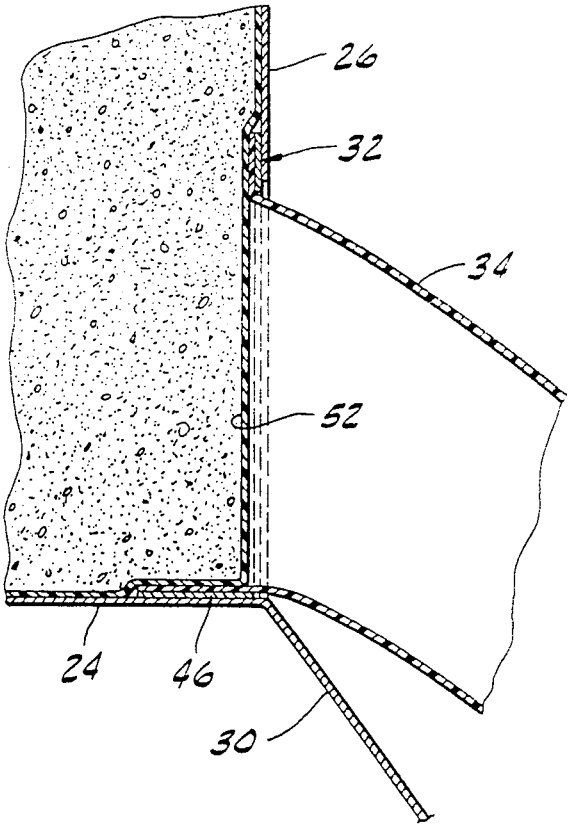
FIG. 5 is a view similar to FIG. 4 showing the removable portion removed and the discharge tube extended.

As shown in FIG. 5, portion 30 can be folded down, or removed entirely, to form an opening in the sidewall extending down to the bottom of the container. The folded discharge tube 34 is pulled outwardly through the opening and unfolded for discharge of the container's contents through the tube. The wall of liner 52 can then be cut or ruptured to allow the contents to pour through the discharge tube 34.

Discharge tube 34 provides control over the direction of flow of the material and can even be choked off to stop flow, if necessary. The tube also minimizes and contains dust from the material. Because the tube extends from adjacent the bottom of the container, all the contents can be emptied from the container with a minimum of shaking or tipping.

There are various changes and modifications which may be made to this invention as would be apparent to those skilled in the art. However, any of these changes or modifications are included in the teachings of this disclosure, and it is intended that this invention be limited only by the scope of the claims appended hereto.

What is claimed is:

1. A container for fluent material in bulk quantity, said container having a top, a bottom, and at least one sidewall, means defining a portion of said one sidewall to be removed thereby to form an opening in the sidewall adjacent the bottom of the container, said sidewall portion being generally flush with the remainder of the sidewall, a flange around the opening on the inside of said at least one sidewall, and a side discharge tube of flexible sheet material attached at one end to the inside face of the flange, said tube initially being folded compactly on the inside of the container adjacent said sidewall portion to be removed and being accessible upon removal of said sidewall portion so that it may be pulled outwardly through said opening and unfolded for discharge of fluent materials from the container through the side discharge tube, the flange being disposed in overlapping relation to said means defining the portion of the sidewall to be removed whereby the flange is adapted to function as a backup member to prevent damage to the side discharge tube in the event the sidewall is cut or punctured to remove said sidewall portion.

2. A container as set forth in claim 1 wherein said container is of cardboard and said means defining a portion of said one sidewall comprises a line of weakness.

3. A container as set forth in claim 2 wherein the line of weakness comprises a line of perforations.

4. A container as set forth in claim 1 wherein the means defining a portion of said one sidewall comprises indicia on the sidewall indicating where the sidewall can be cut.

5. A container as set forth in claim 1 wherein said flange is generally rectangular with top, bottom and side portions, the bottom portion of the flange being bent to lie generally flat against the bottom of the container on the inside of the container, and the top and side portions lying generally flat against said one sidewall of the container on the inside of the container.

6. A container as set forth in claim 5 wherein said flange is of cardboard and secured to the inside of the container by adhesive.

7. A container as set forth in claim 6 wherein said one end of the discharge tube is secured to the inside face of the flange.

8. A container as set forth in claim 1 wherein said container has a plurality of sidewalls and is octagonal in shape.

9. A container as set forth in claim 1 further comprising a liner on the inside of the container, said flange being disposed between the liner and said one sidewall of the container, said liner being adapted to be cut to enable flow of material into the side discharge tube.

10. A container as set forth in claim 9 wherein said container is of cardboard and said means defining a portion of said one sidewall comprises a line of weakness in the sidewall.

11. A container as set forth in claim 10 wherein said flange is generally rectangular having top, bottom and side portions, the bottom portion of the flange being bent to lie generally flat against the bottom of the container on the inside of the container, and the top and side portions lying generally flat against said one sidewall of the container on the inside of the container.

12. A container for fluent material in bulk quantity, said container having a top, a bottom, and at least one sidewall, a line of weakness defining a portion of said one sidewall adjacent the bottom of the container to be removed to form an opening in the sidewall adjacent the bottom of the container, a flange around the opening on the inside of the container, the flange being generally rectangular with top, bottom, and side portions, the bottom portion of the flange being bent to lie generally flat against the bottom of the container on the inside of the container, and the top and side portions lying generally flat against said one sidewall of the container on the inside of the container, and a side discharge tube of flexible sheet material attached at one end to the inside face of the flange, said tube initially being in a folded condition on the inside of the container and being accessible upon removal of the sidewall portion so that it may be pulled outwardly through said opening and unfolded for discharge of fluent material from the container through the side discharge tube, the flange being disposed in overlapping relation to said line of weakness whereby the flange is adapted to function as a backup member to prevent damage to the side discharge tube in the event the sidewall is cut or punctured to remove said sidewall portion.

13. A container as set forth in claim 12 further comprising a liner on the inside of the container, said flange being disposed between the liner and said one sidewall of the container, said liner being adapted to be cut to enable flow of material into the discharge tube.

14. A container as set forth in claim 12 wherein the line of weakness comprises a line of perforations.

15. A container as set forth in claim 14 wherein said container is octagonal in shape.

16. A cardboard container for fluent material in bulk quantity, said container having a top, a bottom, and a plurality of sidewalls, a line of perforations defining a portion of one sidewall adjacent the bottom of the container that can be removed to form an opening in the sidewall adjacent the bottom of the container, a generally rectangular flange around the opening on the inside of the container having top, bottom, and side portions, the bottom portion of the flange being bent to lie generally flat against the bottom of the container on the inside of the container, and the top and side portions of the flange lying generally flat against said one sidewall of the container on the inside of the container, a side discharge tube of flexible sheet material attached at one end to the inside face of the flange, said flange being disposed in overlapping relation to said line of perforations whereby the flange is adapted to function as a backup member to prevent damage to the side discharge tube in the event the sidewall is cut or punctured to remove said sidewall portion, said tube initially being in a folded condition on the inside of the container and being accessible upon removal of the sidewall portion so that it may be pulled outwardly through said opening and unfolded for discharge or fluent material from the container through said side discharge tube, and a liner on the inside of the container, the flange being disposed between the liner and said one sidewall of the container, said liner being adapted to be cut to enable flow of the material into the side discharge tube.

17. A container as set forth in claim 16 wherein said container is octagonal in shape.

* * * * *